US010861618B2

(12) United States Patent
Aufdembrink et al.

(10) Patent No.: US 10,861,618 B2
(45) Date of Patent: Dec. 8, 2020

(54) ENZYMATICALLY-DEGUMMED OIL AND USES THEREOF

(71) Applicant: CARGILL, INCORPORATED, Wayzata, MN (US)

(72) Inventors: Brent Aufdembrink, Medina, MN (US); Kevin J. Rapp, Oak Creek, MN (US); Charles M. Tanger, Minneapolis, MN (US)

(73) Assignee: CARGILL, INCORPORATED, Wayzata, MN (US)

( * ) Notice: Subject to any disclaimer, the term of this patent is extended or adjusted under 35 U.S.C. 154(b) by 0 days.

(21) Appl. No.: 16/005,106

(22) Filed: Jun. 11, 2018

(65) Prior Publication Data

US 2018/0294068 A1 Oct. 11, 2018

Related U.S. Application Data

(62) Division of application No. 14/654,167, filed as application No. PCT/US2013/077058 on Dec. 20, 2013, now Pat. No. 9,997,273.

(60) Provisional application No. 61/739,877, filed on Dec. 20, 2012.

(51) Int. Cl.

| | |
|---|---|
| ***H01F 27/12*** | (2006.01) |
| ***H01B 3/20*** | (2006.01) |
| ***C11B 3/00*** | (2006.01) |
| ***C11B 3/10*** | (2006.01) |

(52) U.S. Cl.

CPC ..... *H01B 3/20* (2013.01); *C11B 3/003* (2013.01); *C11B 3/10* (2013.01); *H01F 27/12* (2013.01)

(58) Field of Classification Search

CPC ..... H01F 27/00–40; H01B 3/20; C11B 3/10; C11B 3/003

USPC ..... 336/55–62

See application file for complete search history.

(56) References Cited

U.S. PATENT DOCUMENTS

| | | | | |
|---|---|---|---|---|
| 4,142,003 | A | 2/1979 | Sejpal | |
| 5,260,077 | A | 11/1993 | Carrick et al. | |
| 6,613,250 | B2 * | 9/2003 | McShane | C09K 5/10 174/17 LF |
| 6,905,638 | B2 * | 6/2005 | Corkran | C09K 5/10 174/17 LF |
| 8,741,186 | B2 | 6/2014 | Cazares et al. | |
| 9,240,259 | B2 | 1/2016 | Rebouillat et al. | |
| 2002/0049145 | A1 | 4/2002 | Cannon et al. | |
| 2002/0063487 | A1 * | 5/2002 | Leijon | H01F 3/10 310/179 |
| 2003/0164479 | A1 | 9/2003 | Goedde et al. | |
| 2009/0140830 | A1 | 6/2009 | Amanullah et al. | |
| 2012/0119862 | A1 | 5/2012 | Franklin et al. | |
| 2013/0023683 | A1 | 1/2013 | Ruwwe et al. | |
| 2013/0099182 | A1 | 4/2013 | Rebouillat et al. | |

FOREIGN PATENT DOCUMENTS

| | | | |
|---|---|---|---|
| JP | 2007173685 | A * | 7/2007 |
| WO | 02062156 | A2 | 8/2002 |
| WO | 2013052956 | A2 | 4/2013 |

OTHER PUBLICATIONS

De Maria, L. , et al., "Phospholipases and their industrial applications", Applied Microbiology and Biotechnologym vol. 74,Jan. 13, 2007, pp. 290-300, (publisher: Springer-Verlag).

Jiang, Fangyan , et al., "Degumming of vegetable oils by a novel Phospholipase B from Pseudomonas fluorescens BIT-18", Bioresource Technology, vol. 102, May 26, 2011, 8052-8056. (Elsevier).

* cited by examiner

*Primary Examiner* — Tuyen T Nguyen

(57) ABSTRACT

An electrical device containing an enzymatically-degummed vegetable oil is disclosed. Also disclosed are methods for insulating and cooling a transformer using enzymatically-degummed vegetable oils, and methods for adding an enzymatically-degummed vegetable oil to an enclosure of an electrical device. Further disclosed are processes for making dielectric fluids using enzyme-degumming of vegetable oils or using enzyme-degummed vegetable oils as the starting material for the process.

13 Claims, No Drawings

ENZYMATICALLY-DEGUMMED OIL AND USES THEREOF

CROSS-REFERENCE TO RELATED APPLICATIONS

This Application is a Divisional Application of U.S. application Ser. No. 14/654,167, filed Jun. 19, 2015, and entitled ENZYMATICALLY-DEGUMMED OIL AND USES THEREOF, which Application is a national phase Application of International Application Serial No. PCT/US2013/077058, filed Dec. 20, 2013 and entitled ENZYMATICALLY-DEGUMMED OIL AND USES THEREOF, which application claims the benefit of U.S. Provisional Application No. 61/739,877, filed Dec. 20, 2012, and entitled ENZYMATICALLY-DEGUMMED OIL AND USES THEREOF, each of which applications are hereby incorporated by reference in their entirety.

TECHNICAL FIELD

The present disclosure relates generally to dielectric coolants comprising enzymatically-degummed vegetable oils. The dielectric coolants are particularly suited for use in sealed, non-vented electrical devices, and have desirable performance characteristics, including minimal degradation of the paper insulating layers of the electrical device, as well as a high degree of safety and environmental acceptability.

BACKGROUND

Dielectric fluids used to electrically insulate and cool electrical devices can require extensive processing to remove harmful constituents and contaminants that can impact electrical performance and/or longevity of the electrical device. Conventionally-refined vegetable oils, such as those described in Bailey's Industrial Oil & Fat Products, Vol. 4, 5th edition, 1996, may require numerous processing steps that lead to consumption of raw materials, time expenditure, and waste generation before the treated vegetable oils are suitable for use as dielectric fluids in electrical devices. Provided are dielectric fluids and methods of preparing dielectric fluids including enzymatically degumming vegetable oils. Enzymatic degumming of raw vegetable oil can remove polar contaminants that are potentially harmful to electrical devices through processes that may be more efficient than conventional acid- or caustic-vegetable oil refining processes.

SUMMARY

In one embodiment the invention comprises an electrical device comprising:

an enzymatically-degummed oil.

In a second embodiment the invention comprises a method of insulating and cooling a transformer, the method comprising: filling a transformer enclosure to from 80% to 120% of capacity with an enzymatically-degummed oil.

In a third embodiment the invention comprises a method of using an enzymatically-degummed oil, the method comprising: adding an enzymatically-degummed oil to an enclosure of an electrical device.

In a fourth embodiment the invention comprises a process for manufacturing a dielectric fluid, the process comprising:

(a) mixing a crude vegetable oil with an acid to hydrate non-hydratable phospholipids;

(b) adjusting the pH of the acidified crude vegetable oil with a base solution;

(c) mixing an aqueous enzyme solution with the pH-adjusted crude vegetable oil from step (b) to enzymatically degum the vegetable oil;

(d) removing water and water-soluble impurities from the vegetable oil/enzyme mixture from step (c) to produce a dewatered vegetable oil;

(e) optionally adding water to the dewatered vegetable oil from step (d);

(f) optionally removing water and water-soluble impurities from the oil from step (e) to produce a dewatered vegetable oil;

(g) drying the dewatered vegetable oil from step (d) or (f);

(h) bleaching and deodorizing the dried vegetable oil to obtain a degummed, bleached and deodorized vegetable oil; and (i) filtering the degummed, bleached and deodorized vegetable oil to produce the dielectric fluid exhibiting an IFT of at least 20 dynes/cm at 25° C., a Dissipation Factor of less than 0.20% at 25° C., an acid value (AV) of less than 0.09 milligrams KOH/gram, and a dielectric breakdown of at least 35 kilovolts (kV).

In a fifth embodiment the invention comprises a process for manufacturing a dielectric fluid, the process comprising:

(a) obtaining an enzymatically-degummed vegetable oil exhibiting a dielectric breakdown of less than 35 kilovolts (kV); and (b) filtering the enzymatically-degummed vegetable oil to produce the dielectric fluid exhibiting an IFT of at least 20 dynes/cm at 25° C., a Dissipation Factor of less than 0.20% at 25° C., an acid value (AV) of less than 0.09 milligrams KOH/gram, and a dielectric breakdown of at least 35 kilovolts (kV).

In a sixth embodiment the invention comprises an electrical device containing the dielectric fluid resulting from the fifth or sixth embodiments.

DETAILED DESCRIPTION

Provided are enzymatically-degummed oils that may be used as dielectric coolants in electrical devices.

Unless otherwise indicated, all numbers expressing quantities of ingredients, properties such as molecular weight, percentages, reaction conditions, and so forth used in the specification and claims are to be understood as being modified by the term "about." Accordingly, unless indicated to the contrary, the numerical parameters set forth are approximations that may depend upon the desired properties sought.

Enzymatic Degumming of Vegetable Oils

Methods of enzymatically degumming oil are known in the art and disclosed, for example, in U.S. Pat. Nos. 5,558,781, 8,076,123, and 8,192,782, which are hereby incorporated by reference in their entireties.

The process of enzymatically degumming a vegetable oil may commonly include the following steps:

(a) mixing a crude vegetable oil with an acid to hydrate any non-hydratable phospholipids;

(b) adjusting the pH of the acidified crude vegetable oil with a base and water;

(c) mixing an aqueous enzyme solution with heated, pH-adjusted crude vegetable oil to enzymatically degum the vegetable oil;

(d) centrifuging the vegetable oil/enzyme mixture to remove water and water-soluble impurities (e.g., enzyme, phosphatide residues);

(e) adding water to the vegetable oil followed by a second centrifugation to remove additional water and water-soluble impurities;

(f) passing the vegetable oil through driers; and (g) bleaching and deodorizing the dried vegetable oil to obtain the degummed vegetable oil suitable for use as a dielectric coolant.

As used herein, the term "vegetable oil", means an oil derived from a plant. Oils are compositions made up of triacylglycerols ("TAG"). Examples of vegetable oils useful in embodiments of the present disclosure include, but are not limited to, rapeseed oil (e.g., a canola oil), corn oil, mustard oil, olive oil, palm oil, palm kernel oil (and fractions), peanut oil, safflower oil, sesame oil, soybean oil, a nut oil (e.g., almond, cashew, walnut), cottonseed oil, *crambe* oil, coconut oil, meadowfoam oil, *vernonia* oil, *lesquerella* oil, *jatropha* oil, *jojoba* oil, grape seed oil, sunflower oil, and mixtures thereof.

An oil useful in embodiments of the present disclosure may include an algal-sourced oil. In some embodiments, an algal-sourced oil may be mixed with a vegetable oil.

Acids suitable for use in acidifying crude vegetable oil (step (a)) in embodiments of the present disclosure can include organic acids (e.g., citric acid) and inorganic acids (e.g., phosphoric add).

Mixing at various stages of the procedure may be accomplished using devices known to those of ordinary skill in the relevant arts. Mixing devices may include, for example, high-sheer mixing devices. High-sheer mixing devices are commercially available from, for example, Silverson Machines, Inc., East Longmeadow, Mass., USA, Charles Ross & Son Company, Hauppapauge N.Y., USA, Admix Incorporated, Manchester, N.H., and IKA Works Inc., Wilmington, N.C., USA.

Bases suitable for use in adjusting the pH of the acidified vegetable oil (step (b)) in embodiments of the present disclosure can include inorganic bases, such as, for example, sodium hydroxide, potassium hydroxide, and combinations thereof.

Enzymes useful in embodiments of the present disclosure (step (c)) include phospholipases, such as, for example, A-1, A-2, B, and C phospholipases. The amount of enzyme used commonly depends upon the concentration of the enzyme as supplied from the manufacturer and the activity of the enzyme.

In some embodiments, step (c) of an enzymatic degumming process performed according to methods of the present disclosure may be carried out at about 130-140° F. In some embodiments, step (c) of an enzymatic degumming process performed according to methods of the present disclosure may take about two hours to about four hours to complete. In some embodiments, the reaction mixture from step (c) may be heated to about 170° F. and the aqueous phase and the lighter oil phase may be separated using a disk stack centrifuge.

In some embodiments, step (d) of the enzymatic-degumming process as described above, i.e., separation of the enzymatically-degummed oil from the aqueous phase containing the enzyme and phosphatide residues, may be accomplished using disk stack centrifuges.

Disk stack centrifuges that may be used in embodiments of steps (c) and (d) of the disclosed enzymatic-degumming processes are commercially available, e.g., LAVAL PX-115 available from Alfa Laval, Rudeboksvagen, Sweden and WESTFALIA RX-220 available from GEA Westfalia, GEA Mechanical Equipment US, Inc. Northvale, N.J., USA.

In some embodiments, the oil phase resulting from centrifugation (step (d)) may be heated to about 185° F. and washed with water, which is removed in a second round of centrifugation (step (e)). In some embodiments, the wash water may be about 3 wt % to about 8 wt % of the oil stream. In some embodiments, the water may be injected in-line with mixing. In some embodiments, in-line injection of water with oil may be accomplished using in-line static mixers and/or a tank with mechanical mixing.

In some embodiments, after completion of step (e) of the enzymatic-degumming process, the oil may contain about 0.5 wt % water. In some embodiments, the oil may be dried (step (f)) to enhance the bleaching step (g). In some embodiments, drying may be accomplished using a vacuum using techniques known to one of ordinary skill in the relevant arts. In some embodiments, drying of the oil may be accomplished using a spray-drying column in which the oil is sprayed through nozzles into the top of a tank held under vacuum operating at about 175° F. to about 190° F. with a vacuum of about 5 Torr to about 40 Torr (e.g., about 28-29 Inches Hg).

Bleaching (step (g)) may be accomplished by slurrying the dried oil with clay at an elevated temperature under vacuum using methods known to those of skill in the relevant arts. In some embodiments, clays suitable for bleaching may include acid-activated days. Acid-activated clays that may be useful in performing methods of the present disclosure are available commercially and include, but are not limited to, materials such as TONSIL 126 FF (Clariant, Muttenz, Switzerland) and PERFORM 5000 (Oil-Dri Corporation, Chicago, Ill., USA). Enzyme-degumming processes according to methods of the present disclosure can allow for the use of less clay during bleaching than is required in conventional caustic refining processes. In some embodiments, bleaching may include the use of about 2 wt % to about 0.1 wt % clay (e.g., about 0.3 wt % clay), about 1 wt % to about 0.1 wt % clay, about 0.9 wt % to about 0.1 wt % clay, about 0.8 wt % to about 0.1 wt % clay, about 0.7 wt % to about 0.1 wt % day, about 0.6 wt % to about 0.1 wt % clay, about 0.5 wt % to about 0.1 wt % clay, or about 0.4 wt % to about 0.1 wt % clay. In some embodiments, bleaching may include the use of about 0.3 wt % to about 0.2 wt % clay (e.g., about 2.5 wt % clay). In some embodiments, the clay may be removed from the oil using pressure leaf filters, such as those manufactured by Industrial Filters Co., Fairfield, N.J., USA and AMAFILTERS available from Mahle Industrial Filtration, Alkmaar, The Netherlands. In some embodiments, bleaching may reduce oil color, as measured on the Lovibond scale, from about 30-50 red to about 8-11 red.

Volatile impurities in the oil such as, for example, aldehydes, ketones, and acids, which can contribute to odor, taste, color, and poor electrical properties, may be removed by deodorization. In some embodiments, deodorization can be carried out in a batch, semi-continuous, or continuous mode. A comprehensive discussion of deodorization processes and equipment design is provided in *Bailey's Industrial Oil & Fat Products*, Volume 4, Fifth Edition, 1996, which is hereby incorporated by reference in its entirety.

In some embodiments of the deodorization process, bleached oil may be heated to about 465° F. to about 510° F. and contacted with about 0.5 wt % to about 1.5 wt % steam in a column held at low pressure (e.g., about 1 Torr to about 10 Torr). In some embodiments, the steam may rise to the top of the column, carrying with it the volatile components, whereas the deodorized oil can exit at the bottom of the column. Manufacturers of deodorization columns include, but are not limited to, Alfa Laval, Marietta, Ga., USA, DeSmet Ballestra, Paris, France, and Crown Iron Works, Roseville, Minn., USA. In some embodiments, the oil entering the deodorizer may have a free fatty acid content of about 0.5 wt % and a Lovibond red color of about 8 to about 11. In some embodiments, the deodorized oil exiting the deodorizing column may have a free fatty acid content of about 0.01 wt % to about 0.02 wt % and a Lovibond red color of about 0.1 to about 1.

The suitability of an oil for a particular application can be measured, for example, by tests known to those of skill in the relevant arts. Such tests may include ASTM D1816, which may be used to determine dielectric breakdown strength and ASTM D1533, which may be used to measure the water content of the oil.

There are known correlations between the levels of water, dissolved contaminants, and suspended particles in an oil and the dielectric performance of the oil; the higher the levels of water, dissolved contaminants, and suspended particles, in an oil, the lower the dielectric breakdown strength of the oil. An enzyme-degummed oil may be a purer oil compared to a conventional caustic-refined oil, and thus may be processed in a shorter time period with reductions in purifying materials, energy, and contaminants that lower the dielectric breakdown strength.

An enzyme-degummed oil suitable for use in an electrical device may require additional purification steps beyond refining, bleaching, and deodorizing ("RBD"). These additional purification steps can occur before and/or after addition of additives that may improve certain properties of the oil, such as, for example, oxidation stability, cold flow, and microbial activity. The additional purification steps may become particularly important for electrical insulating coolants used in large power transformers classified as medium, high, and extra-high voltages.

In some embodiments, an oil suitable for use in an electrical device may be further purified to reduce water, dissolved gases (e.g., oxygen, carbon dioxide, hydrogen, methane, ethane, ethylene, acetylene), dissolved contaminants (e.g., propanal, decanal, nonanal, 2-pentylfuran, alcohols, acids), and suspended particles and/or waxes.

In some embodiments, the water saturation level of the enzyme-degummed oil may be about 1000 ppm at ambient temperature (e.g., 20-25° C.). In some embodiments, the water content of the enzyme-degummed oil may be reduced to less than about 20% of the saturation level of the enzyme-degummed oil (i.e., less than about 200 parts per million (ppm)) by one or more methods known to those of skill in the relevant arts. Such methods may include, for example, evaporation using reduced pressure, the use of water absorbents (e.g., silica gel, molecular sieves, alumina), filtration, and combinations thereof. In some embodiments the water in the enzyme-degummed oil may be reduced to about 5% to about 10% of the saturation level of the enzyme-degummed oil.

Dissolved gases in the enzyme-degummed oil may be reduced to levels required for use as dielectric fluids as specified, for example, in IEEE C57.147-2008, "Guide for Acceptance and Maintenance of Natural Ester Fluids in Transformers" or other relevant specification for the intended use by methods known to those of skill in the relevant arts, such as by, for example, using reduced pressure and heating of the enzyme-degummed oil.

Dissolved contaminants in the enzyme-degummed oil can be reduced using absorbent media, such as, for example, fullers earth, alumina, or other absorbent media known to those skilled in the relevant arts, while heating the enzyme-degummed oil followed by separation of the enzyme-degummed oil from the absorbent.

Suspended particles and/or waxy crystals can be removed from the enzyme-degummed oil by methods known to those of skill in the relevant arts, such as, for example, by particle filtration using a cartridge filter with a pore size of about 5 microns to about 0.5 microns.

In some embodiments, an enzyme-degummed oil suitable for use in electrical devices may contain additives that can enhance performance properties of the enzyme-degummed oil during operation of the devices over their expected lives, e.g., about 20 years. Suitable additives are known to those of skill in the relevant arts and may include, for example, antioxidants, pour point depressants, antimicrobial agents, and dyes.

The suitability of an oil for use in electrical devices may be determined by quantitative testing, such as, for example, the Interfacial Tension of Oil Against Water by the Ring Method test ("IFT") and a dissipation factor test. The results from the IFT and dissipation factor tests may be interrelated and can indicate the presence of small amounts of soluble polar, molecular contaminants that may be undesirable in electrical devices and may cause deterioration of the electrical performance of the dielectric fluid in an electrical device. Lower IFT values commonly correspond with higher amounts of polar contaminants and poor electrical quality of the oil. Dissipation factor of the oil is a measure of the dielectric losses in an electrical insulating fluid that increase with increases in polar contaminants.

In some embodiments, enzymatically degummed oil prepared according to methods of the present disclosure may exhibit an IFT value of greater than about 22 dynes/cm at 25° C. as determined using Standard Test Method D971-99a.

In some embodiments, enzymatically degummed oil prepared according to methods of the present disclosure may exhibit a dissipation factor of about 0.03% to about 0.09% at 25° C., about 0.03% to about 0.05% at 25° C., or 0.05% to about 0.08% at 25° C. as determined using Standard Test Method D924-08.

Use of Enzymatically-Degummed Vegetable Oils in Electrical Devices

Many types of electrical devices contain a dielectric coolant that functions to electrically insulate and cool energized components from internal parts and the enclosure, and to dissipate heat that is generated by the energized components. As detailed above, the present disclosure provides enzymatically-degummed vegetable oils that can be useful as dielectric coolants in electrical devices, such as, for example, reactors, switchgears, regulators, tap changer compartments, high voltage bushings, oil-filled cables, computers including an oil-filled computer housing, and transformers.

Transformer fabrication and function are known in the art and disclosed, for example, in U.S. Pat. No. 5,766,517, which is hereby incorporated herein in its entirety. A transformer is a device that transfers electrical power from one circuit to another circuit by electromagnetic means. Transformers are utilized extensively in the transmission of electrical power from the generating end of the system to the end user and in between. Transformers are subdivided into power classes that operate at medium, high, and extra-high voltages, distribution classes that operate at low to medium voltages, and instrument transformers that serve as an input source of voltage and current from a higher voltage electric power system to lower voltage instruments, relays, meters, and control devices.

Transformers can be highly efficient, operating with efficiencies as high as 97-99%. Losses in the transformation process can arise from a number of sources, but all losses result in heat production. Even though transformers can operate efficiently at relatively high temperatures, excessive heat may be detrimental to transformer life. Thus, it is important to maintain acceptably-low temperatures within the transformer.

To prevent harmful increases in temperature and concurrent premature transformer failure, transformers can be made including a liquid coolant to dissipate the heat generated during normal transformer operation. The coolant may also function to electrically insulate the transformer components, i.e., function as a dielectric coolant. Commonly, the dielectric fluid covers and surrounds the core and coil assembly of the transformer, filling voids in the insulation and elsewhere within the transformer where air and/or contaminants may otherwise collect and lead to the premature failure of the transformer.

In embodiments of the present disclosure, the dielectric coolant may be an enzymatically-degummed oil as described above. In some embodiments, the transformer may be a distribution-class transformer that has a rating of about 15 kVA to about 5,000 kVA. In some embodiments, the transformer may be a 15 kVA distribution-class transformer having a cylindrical enclosure and a headspace of air above a volume of 10 gallons of dielectric insulating coolant. In some embodiments, the transformer may be a 138 kV, 50 MVA medium voltage power class transformer having, for example, a square or rectangular enclosure surrounding a core and a coil assembly (e.g., a shell-form or core-type design) immersed in a suitable dielectric liquid (coolant) with a volume of headspace above the liquid that is filled with an inert gas, such as, for example, nitrogen.

In some embodiments, the transformer may be a power-class transformer that has a rating of about 5 MVA to about 1,200 MVA. In some embodiments, the transformer may be a 220 kV, 200 MVA high-voltage power-class transformer having, for example, a square or rectangular enclosure surrounding a core and a coil assembly (e.g., a shell-form or core-type design) immersed in a suitable dielectric liquid (coolant) with a volume of headspace above the liquid that is filled with an inert gas, such as, for example, nitrogen. Other design features will be known by those skilled in the relevant arts.

In some embodiments the oil-filled computer may be a super computer or high-heat generating computer that can be immersed in a housing or container that contains an enzyme-degummed oil of the present disclosure and function electrically while still operating at temperatures that protect internal materials from heat damage. In some embodiments, the computer housing may contain from about one-half gallon of oil to about 100 gallons of oil. In other embodiments, the computer housing may contain at least about 100 gallons of an enzyme-degummed oil, at least about 250 gallons of an enzyme-degummed oil, at least about 500 gallons of an enzyme-degummed oil, at least about 750 gallons of an enzyme-degummed oil, or at least about 1,000 gallons of an enzyme-degummed oil.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. When the claims use the word "or" in reference to a list of two or more items, that word covers all of the following interpretations of the word: any of the items in the list, all of the items in the list, and any combination of the items in the list.

The above detailed descriptions of embodiments of the invention are not intended to be exhaustive or to limit the invention to the precise form disclosed above. Although specific embodiments of, and examples for, the invention are described above for illustrative purposes, various equivalent modifications are possible within the scope of the invention, as those skilled in the relevant art will recognize. For example, while steps are presented in a given order, alternative embodiments may perform steps in a different order. The various embodiments described herein can also be combined to provide further embodiments.

EXAMPLES

Aspects of certain embodiments in accordance with aspects of the disclosure are illustrated in the following Examples. The materials and methods described in these Examples are illustrative and not intended to be limiting.

The benefits of the enzyme degummed vegetable oil for use as a dielectric insulating liquid may be shown by several common tests performed on dielectric fluids. One test is described in Standard Test Method D971-99a as "Interfacial Tension of Oil Against Water by the Ring Method" ("IFT"). The second test is described in Standard Test Method D924-08 as "Dissipation Factor (or Power Factor) and Relative Permittivity (Dielectric Constant) of Electrical Insulating Liquids". Both test methods are found in American Society of Testing Materials Volume 10.03 from 2011. The third test is Acid Value as described in ASTM D974-12 as Standard Test Method for Acid Base Number by Color-Indicator Titration". The fourth test is dielectric breakdown which is determined in accordance with ASTM D1816-12 as "Standard Test Method for Dielectric Breakdown Voltage of Insulating Liquids Using VDE Electrodes".

The results in Table 1 show the advantage of enzyme degumming compared to traditional caustic refining. With enzyme degumming, a given amount of bleaching clay used during the normal refining process reduces the dissipation factor of soybean oil to a much lower value than when a similar amount of bleaching day is used with caustic refining and increases interfacial tension relative to that obtained with caustic refining. This increases the capacity of the downstream dielectric insulating oil production unit, since the amount of time and processing needed to meet specifications for dissipation factor are reduced significantly. Enzyme degumming results in a much more efficient overall process from crude soybean oil to finished dielectric insulating oil (i.e. dielectric fluid). For example, much less bleaching day is necessary for the overall dielectric fluid manufacturing process using enzyme degumming (i.e. from crude vegetable oil to final dielectric fluid) to obtain the desired dissipation factor than is necessary compared to the manufacture of a dielectric fluid using a caustic degumming process.

Example 1

A mixture of 199 grams of crude soybean oil degummed using Purifine PLC enzyme from DSM Food Specialties, and 1.0 grams (0.5% by weight) of Perform 5000 clay from Oil-Dri Corporation was heated with stirring in a 500-ml 3-neck round bottom flask to 110° C. to 115° C. under nitrogen. Stirring was continued for 30 minutes during which time water from the clay was observed to condense on the upper walls of the flask. A vacuum was slowly applied to a final pressure of approximately 10 Torr to remove the water. The dried oil and clay mixture was vented to nitrogen and allowed to cool to approximately 70° C. The oil-clay mixture was vacuum filtered through Whatman #4 filter paper to obtain a clear, yellow oil.

Example 2

A mixture of 198 grams of crude soybean oil degummed using Purifine PLC enzyme from DSM Food Specialties, and 2.0 grams (1.0% by weight) of Perform 5000 clay from Oil-Dri Corporation was treated and tested in the manner described in Example 1.

Example 3

A mixture of 199 grams of crude soybean oil degummed using Lecitase Ultra PLA enzyme from Novozyme, and 1.0 grams (0.5% by weight) of Perform 5000 clay from Oil-Dri Corporation was treated and tested in the manner described in Example 1.

Example 4

A mixture of 198 grams of crude soybean oil degummed using Lecitase Ultra PL enzyme from Novozyme, and 2.0 grams (1.0% by weight) of Perform 5000 clay from Oil-Dri Corporation was treated and tested in the manner described in Example 1.

Example 5

A mixture of 199 grams of crude soybean oil degummed using caustic refining, and 1.0 grams (0.5% by weight) of Perform 5000 clay from Oil-Dri Corporation was treated and tested in the manner described in Example 1.

Example 6

A mixture of 198 grams of crude soybean oil degummed using caustic refining, and 2.0 grams (1.0% by weight) of Perform 5000 clay from Oil-Dri Corporation was treated and tested in the manner described in Example 1.

Example 7

A mixture of 199 grams of crude soybean oil degummed using caustic refining, and 1.0 grams (0.5% by weight) of Perform 5000 clay from Oil-Dri Corporation was treated and tested in the manner described in Example 1.

Example 8

A mixture of 198 grams of crude soybean oil degummed using caustic refining, and 2.0 grams (1.0% by weight) of Perform 5000 clay from Oil-Dri Corporation was treated and tested in the manner described in Example 1.

Dissipation factor results for the starting crude soybean oils and the clay treated oils from Examples 1 through 8 were measured at 25° C. on an Eltel ADTR-2K from Eltel Industries according to ASTM D924 and are shown in Table 1.

TABLE 1

Experimental Results for Examples 1 through 8—Clay Treatment of Crude Soybean Oil for Use to manufacture a Dielectric Fluid.

| Example | Degumming Method | Clay Used, % by weight | Dissipation Factor @ 25° C. | Interfacial Tension (IFT) @25° C.), dynes/cm |
|---|---|---|---|---|
| Starting Oil | PLC Enzyme | 0 | 100% | 11.7 |
| 1 | PLC Enzyme | 0.5 | 1.09% | 18.4 |
| 2 | PLC Enzyme | 1.0 | 0.37% | 22.4 |
| Starting Oil | PLA Enzyme | 0 | 100% | 25.1 |
| 1 | PLA Enzyme | 0.5 | 0.28% | 26.3 |
| 2 | PLA Enzyme | 1.0 | 0.03% | 31.8 |
| Starting Oil | Caustic | 0 | 100% | 14.4 |
| 1 | Caustic | 0.5 | 8.78% | 15.5 |
| 2 | Caustic | 1.0 | 6.34% | 14.1 |
| Starting Oil | Caustic | 0 | 100% | 22.5 |
| 1 | Caustic | 0.5 | 9.11% | 25.5 |
| 2 | Caustic | 1.0 | 0.44% | 27.8 |

Example 9

The results summarized in Table 2 show the differences in the IFT and dissipation factors of an enzyme-degummed soybean oil prepared according to methods of the present disclosure as compared to a caustic-refined soybean oil which is currently used as a dielectric insulating fluid and which is prepared using similar amounts of clay for bleaching the oil as used for bleaching the enzyme-degummed soybean oil.

TABLE 2

Experimental Results of Enzyme-Degummed versus Caustic-Refined Soybean Oil for Use as Dielectric Insulating Fluid (dielectric fluid)

| Refinery | Process | IFT (dynes/cm) | Dissipation Factor[1] (% at 25° C.) |
|---|---|---|---|
| 1 | Caustic Refined | 20.7 | 0.12 |
| 2 | Enzyme Degum | 25.6 | 0.04 |
| 3 | Enzyme Degunn | 27.4 | 0.08 |

As the data in Table 2 show, the enzyme-degummed oils have higher interfacial tension and lower dissipation factor measurements which correlate with a reduced level of polar contaminants that remain in the enzyme-degummed oil as compared to the caustic-refined oil. The higher IFT and lower Dissipation Factors for the enzyme-degummed oils will lead to dielectric fluids that can be more readily manufactured for a given dissipation factor and IFT, or alternatively, will lead to the manufacture of dielectric fluids having better overall dielectric properties, such as, for example lower Dissipation Factor and higher IFT.

Example 10

A refined, bleached and deodorized (RBD) soybean oil manufactured using an enzyme degumming process similar to that described above, is obtained. The RBD soybean oil exhibits a Dissipation Factor of 0.4%, an acid value of 0.07 mg KOH/gram, a water content of 300 mg/kg, an IFT of 20 dynes/cm, and a dielectric breakdown of 30 kiloVolts. The RBD soybean oil is processed using the following additional steps: 1) The oil is circulated through cartridge filters containing neutral clay available from BASF Corporation, under the tradename Microsorb 60/90, until the dissipation factor is less than or equal to 0.15%. 2) The oil is degassed and dehydrated by heating to 50° C. to 60° C. at a pressure of two Torr or less. 3) The oil is filtered through 0.5 micron filters.

The RBD soybean oil treated in accordance with this Example 10 exhibits a dissipation factor of 0.09% or less, an acid value of 0.06 or less mgKOH/gram, a water content of 30 mg/kg or less, and a dielectric breakdown of 50 kiloVolt or greater at an electrode gap of 2 mm.

In general, the terms used in the following claims should not be construed to limit the invention to the specific embodiments disclosed in the specification, unless the above detailed description explicitly defines such terms. While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

What is claimed is:

1. A method of insulating and cooling a transformer, the method comprising: filling a transformer enclosure to from about 80% to about 120% of capacity with an enzymatically-degummed oil;

wherein the enzymatically-degummed oil is a vegetable oil that has been treated with acid to hydrate non-hydratable phospholipids to provide an acid treated vegetable oil, the acid treated vegetable has been treated with an enzyme to provide a degummed composition comprising enzymatically-degummed oil, enzyme and phosphatide residues, and the enzyme and phosphatide residues, have been removed from the degummed composition to provide an enzymatically-degummed oil;

and wherein the enzymatically-degummed oil exhibits:

(a) an IFT of at least 20 dynes/cm at 25° C., (b) a Dissipation Factor of less than 0.20% at 25° C., (c) an acid value (AV) of less than 0.09 milligrams KOH/gram, and (d) a dielectric breakdown of at least 35 kilovolts (kV).

2. The method of claim 1, wherein the enzymatically-degummed oil is a vegetable oil comprising at least one of a rapeseed oil, a corn oil, a mustard oil, an olive oil, a palm oil, a palm kernel oil, a peanut oil, a safflower oil, a sesame oil, a soybean oil, a nut oil, a cottonseed oil, a *crambe* oil, a coconut oil, a meadowfoam oil, a *vernonia* oil, a *lesquerella* oil, a jatropha oil, a jojoba oil, a grape seed oil, a sunflower oil, and mixtures thereof.

3. The method of claim 1, wherein the transformer is a distribution-class transformer that has a rating of about 15 kVA to about 5,000 kVA.

4. The method of claim 1, wherein the transformer is a power-class transformer that has a rating of about 5 MVA to about 1,200 MVA.

5. The method of claim 1, wherein the enzymatically degummed oil exhibits an IFT of at least 22 dynes/cm at 25° C.

6. The method of claim 1, wherein the enzymatically degummed oil exhibits a Dissipation Factor of less than 0.15% at 25° C.

7. The method of claim 1, wherein the enzymatically degummed oil exhibits a Dissipation Factor of less than 0.10% at 25° C.

8. The method of claim 1, wherein the water content of the enzymatically-degummed oil is 200 milligrams per kilogram of oil or less.

9. The method of claim 1, wherein the water content of the enzymatically-degummed oil is 100 milligrams per kilogram oil or less.

10. The method of claim 1, wherein the water content of the enzymatically-degummed oil is 50 milligrams per kilogram oil or less.

11. The method of claim 1, wherein the enzymatically degummed oil exhibits a dielectric breakdown of at least 50 kilovolts (kV).

12. The method of claim 1, wherein the enzymatically degummed oil exhibits a dielectric breakdown of at least 60 kilovolts (kV).

13. The method of claim 1, wherein the enzymatically degummed oil exhibits an acid value (AV) of 0.06 milligrams KOH/gram or less.

* * * * *